US005409057A

United States Patent [19]

Zifferer

[11] Patent Number: 5,409,057

[45] Date of Patent: Apr. 25, 1995

[54] HEAT EXCHANGE ELEMENT

[75] Inventor: L. Robert Zifferer, Waco, Tex.

[73] Assignee: Packless Metal Hose, Inc., Waco, Tex.

[21] Appl. No.: 6,926

[22] Filed: Jan. 22, 1993

[51] Int. Cl.[6] ..... F28D 7/02

[52] U.S. Cl. ..... 165/156; 165/177; 165/164

[58] Field of Search ..... 138/111, 115, 172, 173, 138/DIG. 11; 165/156, 164, 177

[56] References Cited

U.S. PATENT DOCUMENTS

| | | | |
|---|---|---|---|
| 720,599 | 9/1904 | Monteagle | 138/38 |
| 2,337,490 | 12/1943 | Penner . | |
| 2,365,688 | 12/1944 | Dewey . | |
| 2,667,650 | 2/1954 | Friedman . | |
| 2,733,503 | 2/1956 | Beringer et al. . | |
| 3,004,330 | 10/1961 | Wilkins | 138/115 X |
| 3,292,414 | 12/1966 | Goeke . | |
| 3,468,371 | 9/1969 | Menze | 165/156 |
| 3,863,526 | 2/1975 | Sygnator . | |
| 4,031,745 | 6/1977 | McCarty . | |
| 4,377,083 | 3/1983 | Shepherd et al. . | |
| 4,514,997 | 5/1985 | Zifferer . | |
| 4,523,637 | 6/1985 | Abramo | 165/104.34 |
| 4,672,834 | 6/1987 | Alberto . | |
| 4,993,483 | 2/1991 | Harris . | |

FOREIGN PATENT DOCUMENTS

| | | | |
|---|---|---|---|
| 731354 | 4/1966 | Canada . | |
| 144460 | 6/1985 | European Pat. Off. . | |
| 160498 | 11/1985 | European Pat. Off. | 138/115 |
| 203759 | of 1900 | Germany | 165/164 |
| 57-49795 | 3/1982 | Japan | 165/156 |
| 15510 | of 1914 | United Kingdom | 138/111 |

*Primary Examiner*—Allen J. Flanigan

*Attorney, Agent, or Firm*—Conley, Rose & Tayon

[57] ABSTRACT

Multi-passage heat exchange element which includes an elongated central first fluid passage for passage of a first fluid of a heat exchanger, a plurality of substantially helically convoluted second fluid passages for a second fluid of a heat exchanger, the second fluid passages substantially helically surrounding at least a portion of the elongated central passage, and a plurality of substantially helically convoluted first fluid passages for passage of the first fluid of a heat exchanger, the first fluid passages substantially surrounding at least a portion of the second fluid passages.

40 Claims, 12 Drawing Sheets

HEAT EXCHANGE ELEMENT

BACKGROUND OF THE INVENTION

1. Field of the Invention

This invention relates to an improved heat exchange element with includes a plurality of substantially helically convoluted passages. This heat exchange element may be used in heat exchangers such as tube & tube, shell & coil, and shell & tube heat exchangers and the like.

2. Brief Description of the Prior Art

Finned heat exchange elements are well known in the art for use in radiators, heat exchangers, refrigerators, condensers, etc. Helically corrugated metal tubing heat exchanger elements, and apparatus and methods for making such elements, have been described in the art. See U.S. Pat. No. 4,377,083 to Shepherd et al entitled "Tube Corrugating Apparatus and Method" and U.S. Pat. No. 4,514,997 to Zifferer entitled "Tube Corrugating Die." Both of these patents are hereby incorporated by reference.

SUMMARY OF THE INVENTION

An embodiment of the invention relates to a multi-passage heat exchange element which includes a central first fluid passage for passage of a first fluid of a heat exchanger, a plurality of substantially helically convoluted second fluid passages for a second fluid of a heat exchanger, the second fluid passages substantially helically surrounding at least a portion of the central passage, and a plurality of substantially helically convoluted first fluid passages for passage of the first fluid of a heat exchanger, the first fluid passages substantially surrounding at least a portion of the second fluid passages. The invention also relates to processes for making heat exchange elements, and apparatus to effect such processes.

DESCRIPTION OF THE PREFERRED EMBODIMENTS

Figure 10:
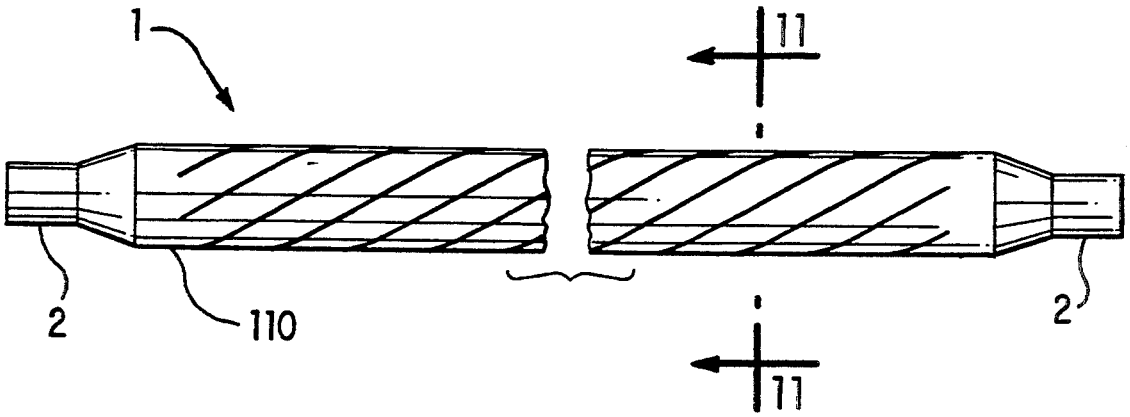
FIGS. 10 and 11 show a multi-passage helical tube element designed for tube & tube, shell & coil, and tube & shell heat exchangers.
Figure 11:
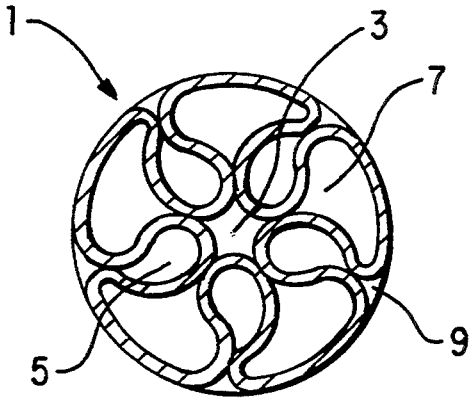

An embodiment of this invention is the multi-passage heat exchange element 1 shown in FIGS. 10 and 11. FIG. 11 is a cross section along lines 11—11 of the tube element shown in FIG. 10. As shown in FIG. 10, preferably the element 1 is elongated.

Element 1 may be adapted to have a reduced diameter end 2, and end 2 may be an ordinary piece of tubing devoid of corrugations or passages. Generally speaking, the heat exchange element 1 is for exchanging heat between a first fluid and a second fluid in a heat exchanger such as a condenser, etc.

The heat exchange element 1 includes a central first fluid passage 3 for passage of a first fluid of a heat exchanger. Preferably the central passage is elongated. In addition, the element 1 also includes a plurality of substantially helically convoluted second fluid passages 5 for a second fluid of a heat exchanger, the second fluid passages 5 substantially helically surrounding at least a portion of the central passage 3. Element 1 further includes a plurality of substantially helically convoluted first fluid passages 7 for passage of the first fluid of a heat exchanger, the first fluid passages 7 substantially surrounding at least a portion of the second fluid passages 5. In a preferred embodiment, the second fluid passages 5 completely surround the central passage 3. In a preferred embodiment the central passage 3 and the first fluid passages 7 completely surround the second fluid passages 5.

Figure 1:
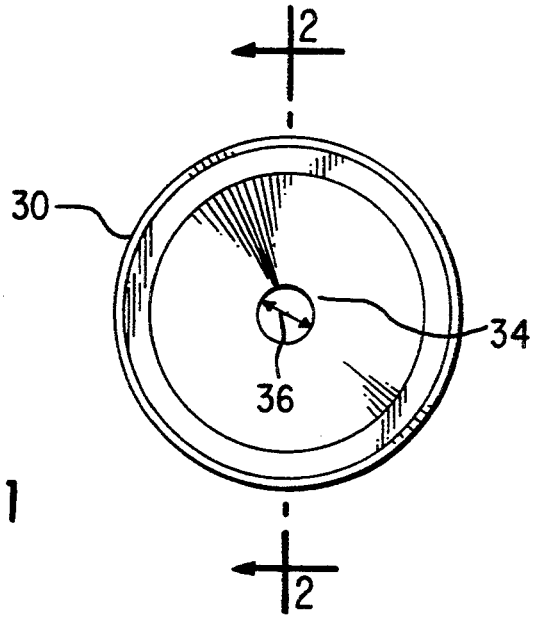
FIG. 1 shows a tapering die.
Figure 2:
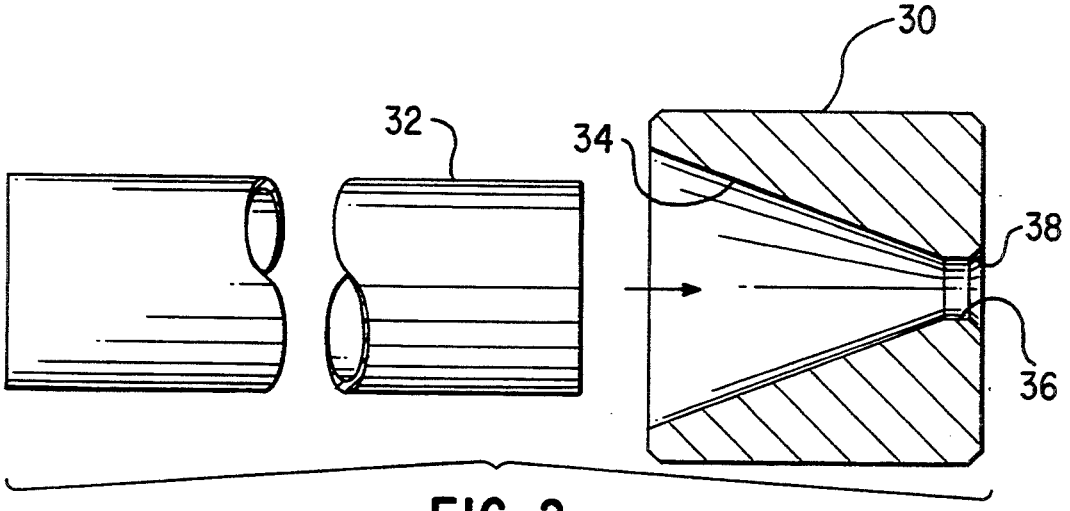
FIG. 2 shows a tube entering into a tapering die.

Element 1 may be made according to the following process. FIG. 1 depicts a tapering die 30 for tapering a tube 32 shown in FIG. 2. Cross section 2—2 of the tapering die 30 is shown in FIG. 2. As shown in FIGS. 1–2, the interior walls 34 of the tapering die 30 are tapered to the diameter 36 desired. Walls 38 on the opposite side of the smallest diameter 36 are slightly flared in order to produce smoother edges on tube that has been tapered by passing through the tapering die 30.

Figure 3:
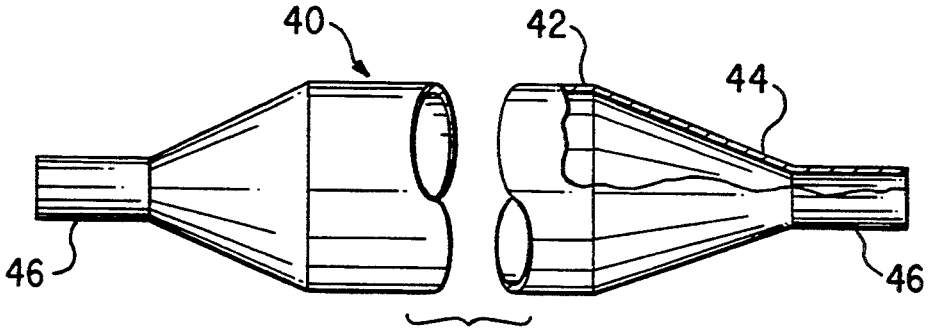
FIG. 3 shows a tube as tapered with at least one tapering die.

In operation tapering die 30 is forcefully applied to tube 32, or vice versa, thereby tapering the ends of the tube 32 to form a tapered tube 40 as shown in FIG. 3. Tapered tube 40 includes a large diameter section 42, tapered tube walls 44, and a small diameter section 46. Walls 44 are preferably tapered between about 15° to 30°, with 20° more preferred.

Figure 4:
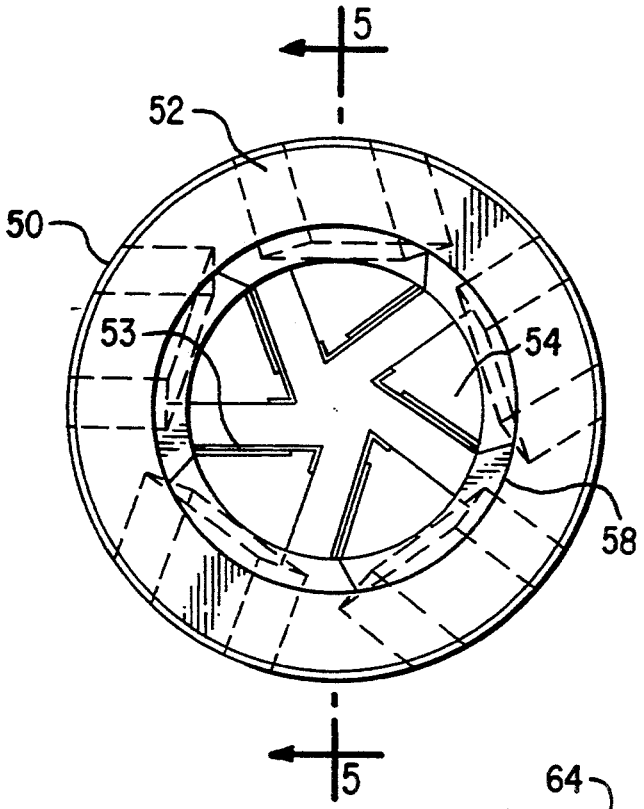
FIGS. 4–5 show a rotatable corrugating die, and the tapered tube prior to passage therethrough.
Figure 5:
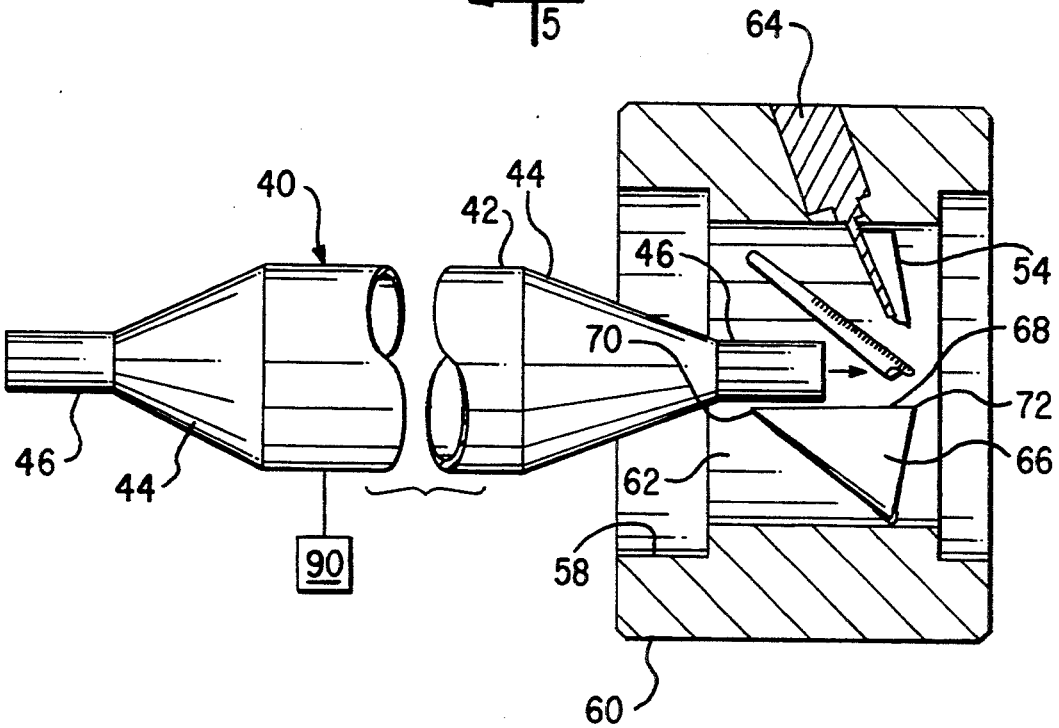

The tapered tube may then be passed into a tube corrugating die 50 shown in FIGS. 4–5. A cross section 5—5 of the corrugating die 50 in FIG. 4 is shown in FIG. 5. The corrugating die 50 may be substantially the same as the corrugating dies shown in U.S. Pat. Nos. 4,377,083 and 4,514,997, except for the cutting edges of the blades or teeth 54 in the die 50 are preferably substantially straight instead of curved.

The corrugating die 50 may include a slotted blade holder 52 and a plurality of removable teeth 54. The corrugating die 50 may also include a bushing seat 58 for insertion of various sized bushings which are adapted to guide the tube 40 into the corrugating die 50. As shown, the corrugating die 50 includes a hollow die body 60 having a longitudinally extending bore 62 therethrough. In addition, the die teeth 54 are preferably placed in the body 60 substantially equidistantly around the circumference of and extending into the bore 62.

Preferably each of the die teeth 54 have a substantially straight supporting base portion 64 supported in the die body 60 at an angle to the longitudinal axis thereof. The teeth 54 also preferably include a corrugating die portion which includes a substantially flat planar plate 66 extending from the base portion 64 radially inward of the bore 62 and having an edge 68 extending substantially straight inward from a root portion 70 adjacent to the surface of the bore to a peak portion 72 radially inward therefrom. The die teeth 54 are preferably angled and spaced such that multiple helically convoluted corrugations in relatively thin walled tubing (i.e. generally tubing with walls less than 0.060 inch thick) are produced by passing the tubing through the die 50 while rotating the die 50 during use.

It is contemplated that the die 50 may be used in an apparatus for corrugating tubing without a supporting mandrel. This type of apparatus is described, for example, in U.S. Pat. Nos. 4,377,083 and 4,514,997. This apparatus preferably includes a device 90 to draw the tubing through the die, or vice versa, which is schematically shown in FIG. 5.

Figure 6:
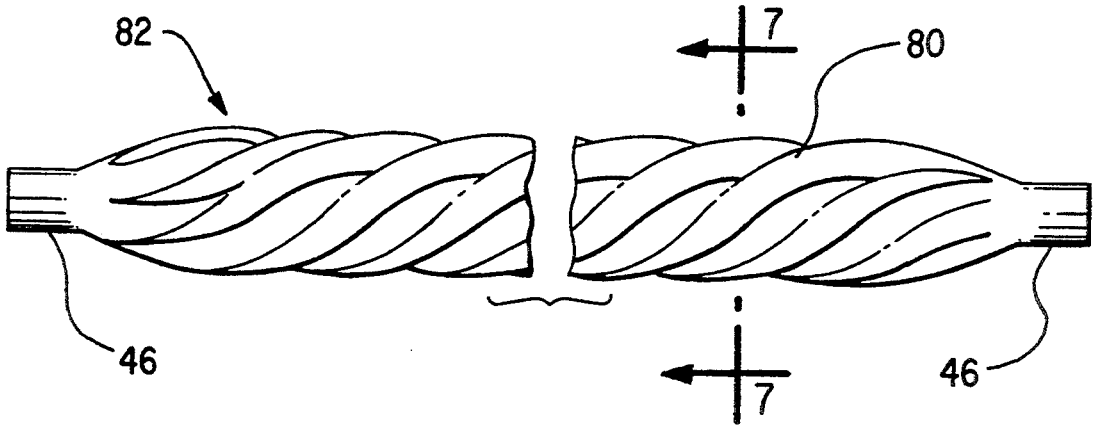
FIGS. 6–7 show helically convoluted corrugated tube elements prepared by passing the tapered tube through the die of FIGS. 4–5.
Figure 7:
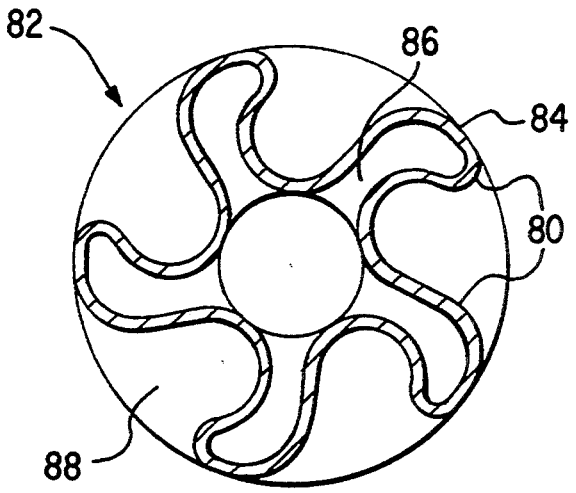

The corrugating die 50 is preferably adapted to produce substantially helically corrugated tube 82 such as shown in FIGS. 6–7. FIG. 7 shows the cross section 7—7 shown in FIG. 6. The corrugations 80 in the corrugated tubing 82 preferably include larger head portions 84 as compared to thinner neck portions 86. More preferably, the corrugations 80 may be substantially "boot" or "shoe" shaped as shown in FIG. 7. It is believed that the larger head portions 84 and thinner neck portions 86 in the corrugations 80 facilitate production of channels 88, which later become passages 5 in the finished element. Because the neck portions 86 are thinner than the head portions 84, the channels 88 which are formed tend to be rounder and broader than channels which would be formed if the neck portions 86 had the same or greater width than the head portions 84. As a result, the rounder and broader channels 88 are adapted to form passages 5. Moreover, the rounder and broader channels 88 may provide additional surface area to increase heat transfer efficiency.

Figure 8:
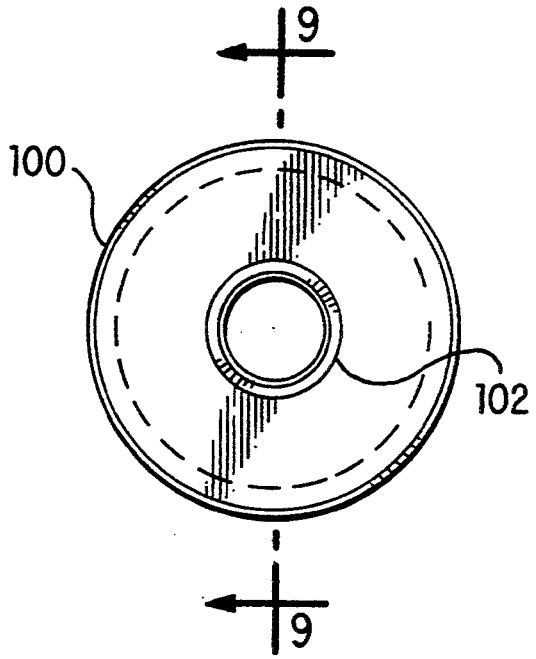
FIGS. 8 and 9 show a reducing die and a tapered helical tube element prior to passage therethrough.
Figure 9:
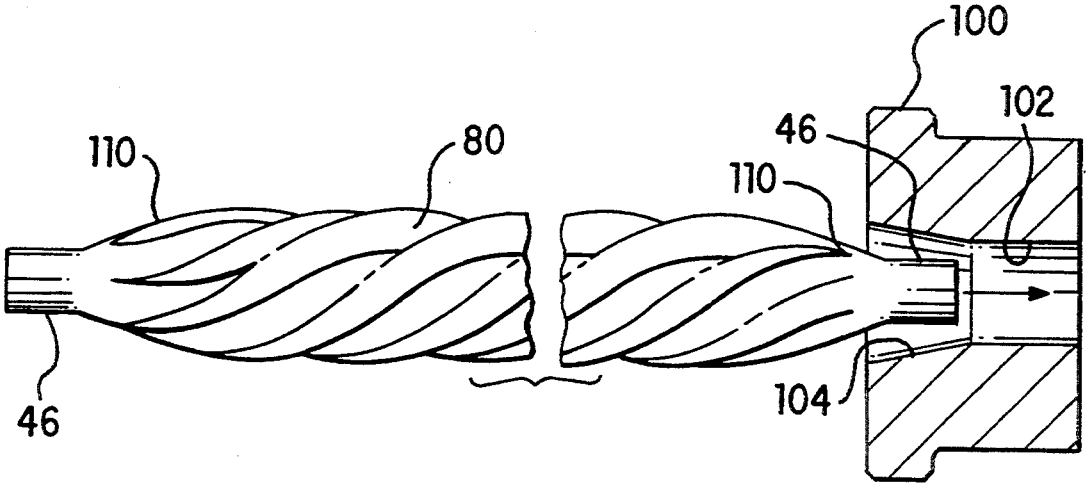

Once the corrugated tube 82 is formed, it may then be used as a heat exchange element. Preferably, however, the corrugated tube 82 is passed through a reducing die 100 such as is shown in FIGS. 8 and 9. FIG. 9 shows the cross section 9—9 shown in FIG. 8. The reducing die 100 may preferably reduce the largest diameter of the corrugated tubing to a diameter corresponding to the reducing die diameter 102 shown in FIGS. 8–9. The reducing die 100 preferably has a tapered wall 104 to effect such reduction. The resultant multi-passage element is shown in FIGS. 10–11.

Figure 16A:
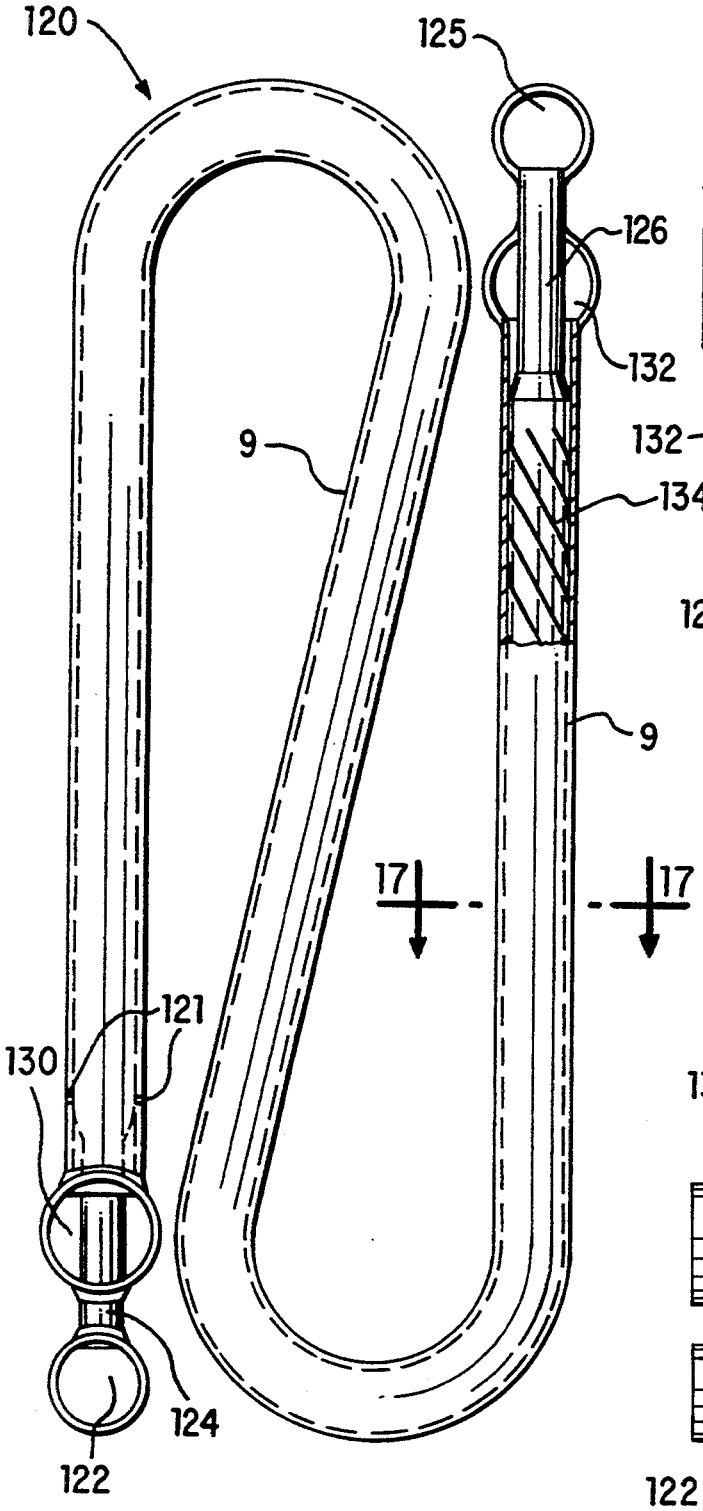
FIGS. 16*a*, 16*b*, and 17 show a typical heat exchanger assembly with a tubular heat exchange element.
Figure 21:
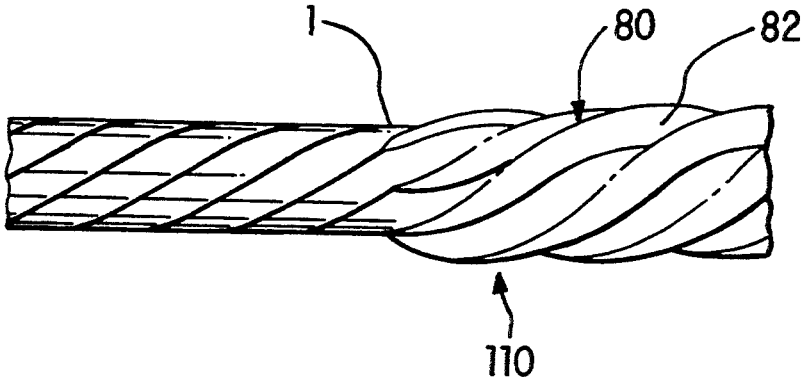
FIG. 21 depicts a section 1 connected to a section 110 of corrugated tube 82.

Preferably diameter 102 of reducing die 100 is larger than diameter 46 of the corrugated tube 82. In this manner the element 1 which is produced such that it is connected to a section 110 of corrugated tube 82, an embodiment of which is shown in FIG. 21 . The corrugations 80 in section 110 are spaced apart from each other such that second fluid can pass between and outside of the corrugations during use (i.e., in the channels 88). In this manner second fluid may be directed from the channels 88 of section 110 into the passages 5 of element 1. Element 1 may be constructed such that second fluid passing in the channels 88 is directed into the second fluid passages 5. This construction may be accomplished by placing a barrier 121 substantially surrounding the passages 5 such that second fluid in the channels 88 is substantially forced into the passages 5 during use. This barrier 121 is shown in FIG. 16*a*. The barrier 121 may be coupled to either or both of the exchanger 120 or the element.

Preferably element 1 is a single-piece construction made from a single piece of material such as metal (e.g. copper tubing). In this context "single piece" refers to an embodiment wherein the central passage 3, and the passages 5 and 7, are all formed from one piece of material (versus alternate embodiments wherein passages 5 or 7 may be made separately and then connected to the central passage 3). It is contemplated that various single piece elements may be joined end-to-end together in a heat exchanger. Even when joined together as such, however, each element would still be a "single piece" element within the scope of the definition given above.

Element 1 may further include an outer second fluid passage, the outer second fluid passage 9 substantially surrounding at least a portion of the first fluid passages 7 and/or at least a portion of the second fluid passages 5. In a preferred embodiment the outer second fluid passage 9 completely surrounds the second fluid passages 5 and the first fluid passages 7. Passage 9 is shown in more detail in FIGS. 16*a* and 17, which shows element 1 in a heat exchanger 120.

Figure 15:
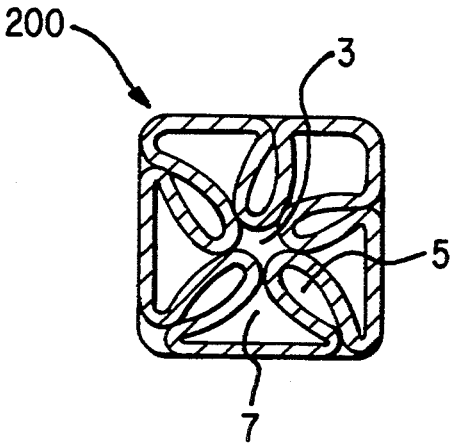

As shown in FIG. 11 a cross section of the element 1 may be substantially circular. As shown in FIG. 15 element 1 may also include a cross section that may is substantially orthogonal (e.g., substantially square or rectangular).

The number of first and/or second fluid passages in element 1 is preferably between 3 and 8. More preferably, this number is between 4 and 6, and more preferably still this number is 5. It has been found that this number of passages may be advantageous in order to make an element 1 wherein the passages fit together such that the fluid in the central passage 3 may only leak minor amounts of fluid to the first fluid passages 7 during use, and vice versa, or that fluid in the second fluid passages 5 may only leak minor amounts of fluid to outer passage 9, and vice versa. A minor amount is believed to be less than about 10% of the total fluid throughput per foot of element 1. The amount of leakage that occurs is dependant on pressure differentials between the passages, which is in turn related to the relative hydraulic efficiency of the passages.

Preferably central passages 3 in the element 1 include a central body portion with a plurality of outwardly extending points such as shown in FIGS. 11 and 15. Preferably second fluid passages 5 are substantially oval or tear-shaped, and preferably first fluid passages 7 are substantially "shoe" or "boot" shaped, such as is shown in FIGS. 11 and 15. The shape of the first fluid passages 7 in FIGS. 11 and 15, although somewhat different, are both within the scope of the definition of "shoe" or "boot" shaped.

An advantage of element 1 is that heat may readily exchange between the walls separating the central passage 3 and the second fluid passages 5, between the walls separating the second fluid passages 5 and the first fluid passages 7, and between the first fluid passages 7 and the outer second fluid passage 9. Thus element 1 provides a compact element with increased heat exchange surface area versus other similar elements known in the art (e.g. corrugated tubing).

Preferably the element 1 includes "prime" surfaces (i.e, surfaces without fins wherein only the wall thickness separates the first fluid from the second fluid). Heat transfer is a function of the surface area and the induced turbulence which is determined by the velocities of the first and second fluids. The magnitude of the temperature difference between the first and second fluids is also related to the quantity of heat transferred.

The element of the invention is believed to provide substantial improvements in performance of prime surface helically convoluted tubes. Moreover, it is believed that this increased performance dramatically reduces the volume of element required for a design heat transfer load. Thus heat exchangers using the element of the invention may be constructed that are smaller and more efficient than those known in the art. The following experiment was conducted to determine the magnitude of the improvements.

EXPERIMENT

A corrugated tube element was prepared as a base test element. To prepare the corrugated tube element, 1.099 inch outside diameter copper tube (0.025 inch wall thickness) was corrugated according to the method and apparatus described in U.S. Pat. No. 4,377,083. The resultant helically convoluted and corrugated tube element corresponded to the element shown in FIG. 22 in the U.S. Pat. No. 4,377,083 patent, with an largest outside diameter of 0.73 inch.

Figure 16B:
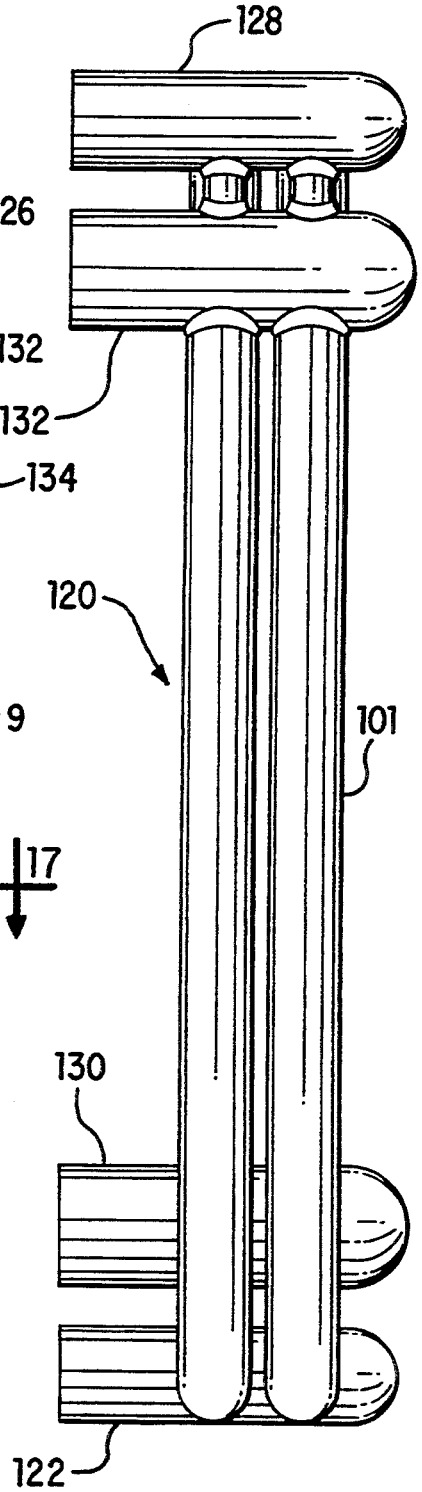
Figure 17:
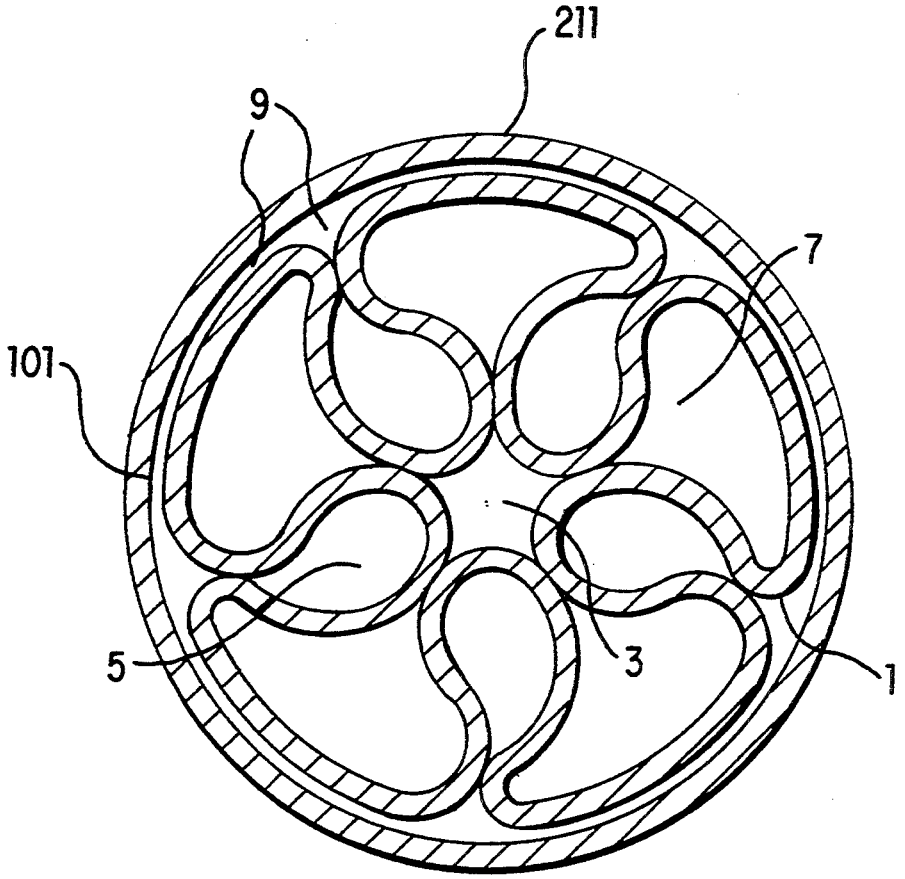

The corrugated tube element was then tested with water as the first fluid (i.e., in the central passage of the pipe) and refrigerant (Freon) as the second fluid. The tube element was inserted into a heat exchanger 120 such as shown in FIGS. 16*a*, 16*b*, and 17. Water passed through entry point 122, neck 124, neck 126, passages 3 and 7, and exit point 128. Refrigerant passed through entry point 130, through passages 9 and 5, and out exit point 132. The element 134 in FIG. 16*a* may be any type of heat exchange element. In this experiment element 134 was first the base test element and then the multi-passage element of the invention.

Water was flowed through exchanger 120 at a rate of 3 gallons per minute, with entering water temperature of 85° F., and exiting water temperature of 95.9° F. Refrigerant entered at 206° F., condensed at 105.1° F., and was subcooled 15° F. The refrigerant flow rate was 162 pounds per hour. The pressure drop of the refrigerant was 4.5 psi.

A standard heat transfer equation of:

$$Q = U.A.[LMTD]$$

was used to calculate heat transfer values. Q is the rate of heat transfer, in Btu/hr, A is the physical heat transfer area, in square feet, U is the overall heat transfer coefficient for the exchanger, in Btu/hr-ft$^2$-°F., and LMTD is the log mean temperature difference, in °F. For the above test element, LMTD was 13.95° F., U was 543 Btu/hr-ft$^2$-°F., A was 2.16 ft$^2$, and Q was 16,350 Btu/hr.

Next, a multi-stage element was prepared and tested. The multi-state element was substantially similar to the element shown in FIGS. 10–11. This element was made of the same material as the test element (copper), had the same outside diameter as the test element (i.e., 0.73 inch), the same wall thickness as the test element (0.25 inch), but was made starting with 1.5 inch outside diameter tube.

The multistage element was tested in the same apparatus as the test element. FIG. 17 shows cross section 17—17 of a multi-passage element of the invention when this element was in heat exchanger 120. In this test, water was flowed through exchanger 120 at a rate of 3 gallons per minute, with entering water temperature of 85° F., and exiting water temperature of 96.2° F. Refrigerant entered at 199.6° F., condensed at 105.1° F., and was subcooled 15° F. The refrigerant flow rate was 173 pounds per hour. The pressure drop of the refrigerant was 3.5 psi. As such, the LMTD was 13.75° F., U was 664 Btu/hr-ft$^2$-°F., A was 1.84 ft$^2$, and Q was 16,800 Btu/hr.

The above experiments show that the multi-state element produced a U value of 664, versus 543 for the test element. Thus the multi-stage element had a heat transfer coefficient that was approximately 23% higher than the heat transfer coefficient of the test element.

In addition to a higher heat transfer coefficient, the multi-stage element was also found to be advantageous in that more heat was transferred per unit volume of heat exchange element. Specifically, about 81 inches of 0.73 inch outside diameter test element (excluding end portions) was required in order to transfer 15,000 Btu/hr (1 ton) of heat. With the multi-stage element, however, only about 56 inches of 0.73 inch outside diameter multi-stage element (excluding end portions) was required in order to transfer 15,000 Btu/hr (1 ton) of heat. The higher heat transfer to volume ratio of the multi-stage element is advantageous since it permits smaller heat exchangers using the multistage element to transfer more heat than older exchangers in the art. Thus substantial size and cost economies can be realized in the construction of heat exchangers such as tube & tube, shell & coil, and tube & shell heat exchangers employing these elements.

Figure 12:
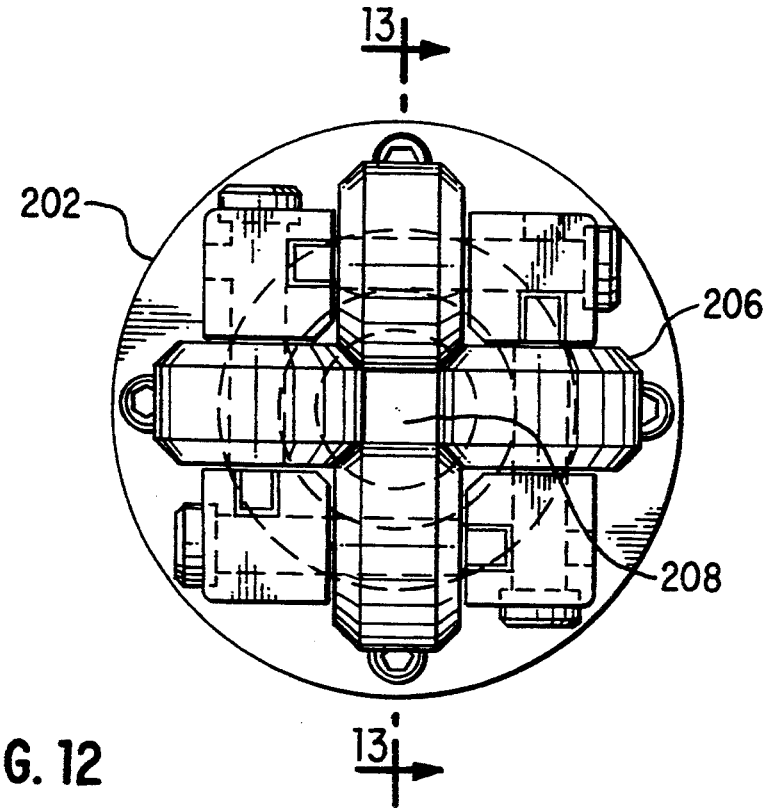
FIGS. 12 and 13 are two views of a Turk's Head and a multi-passage helical tube element prior to passage therethrough.
Figure 13:
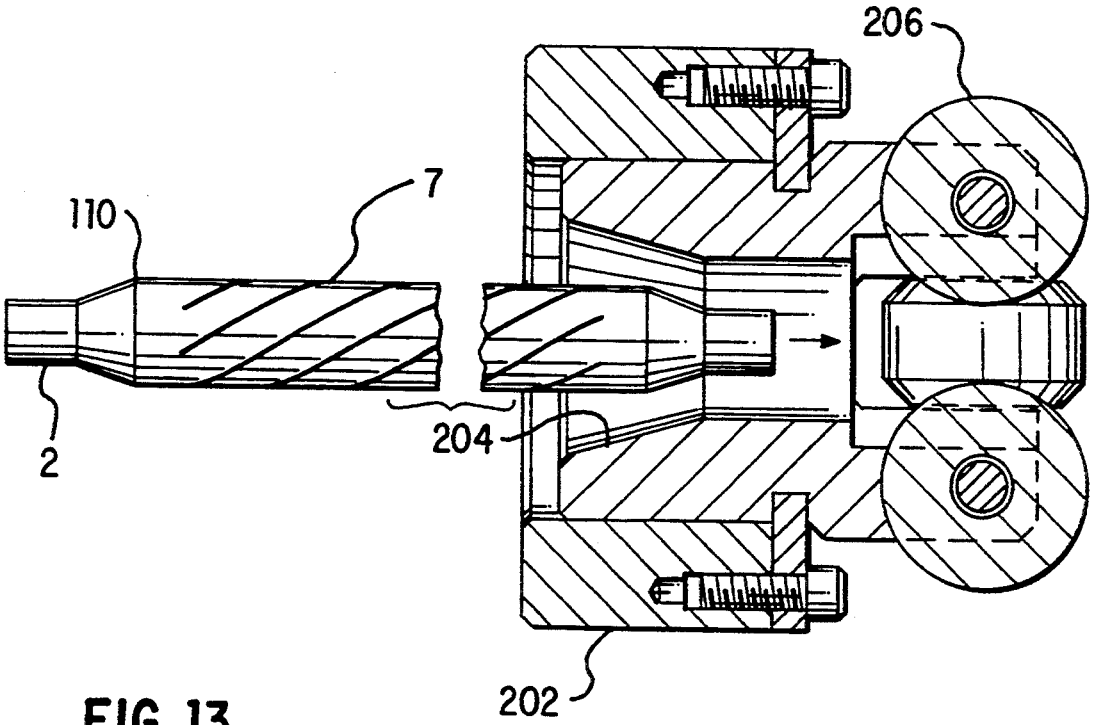
Figure 14:
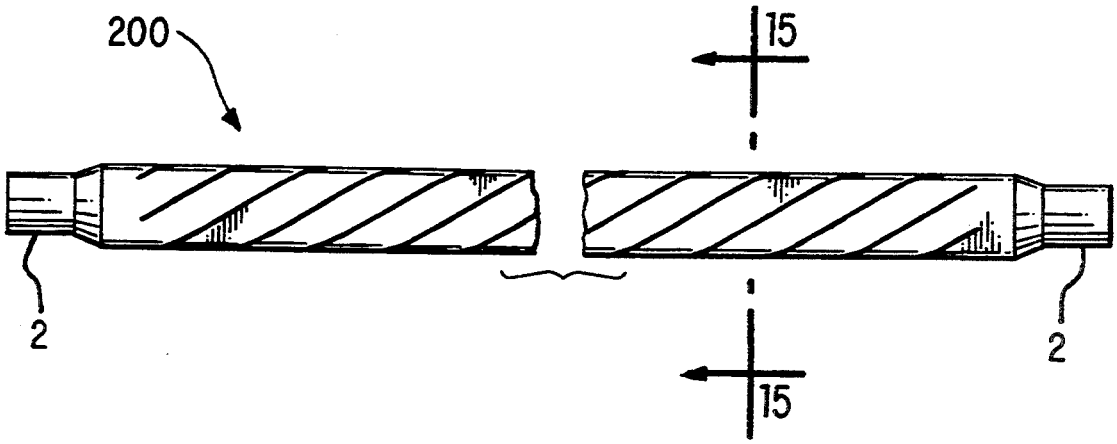
FIGS. 14 and 15 show a orthogonal multi-passage helical element produced by passage through the Turk's Head.
Figure 18:
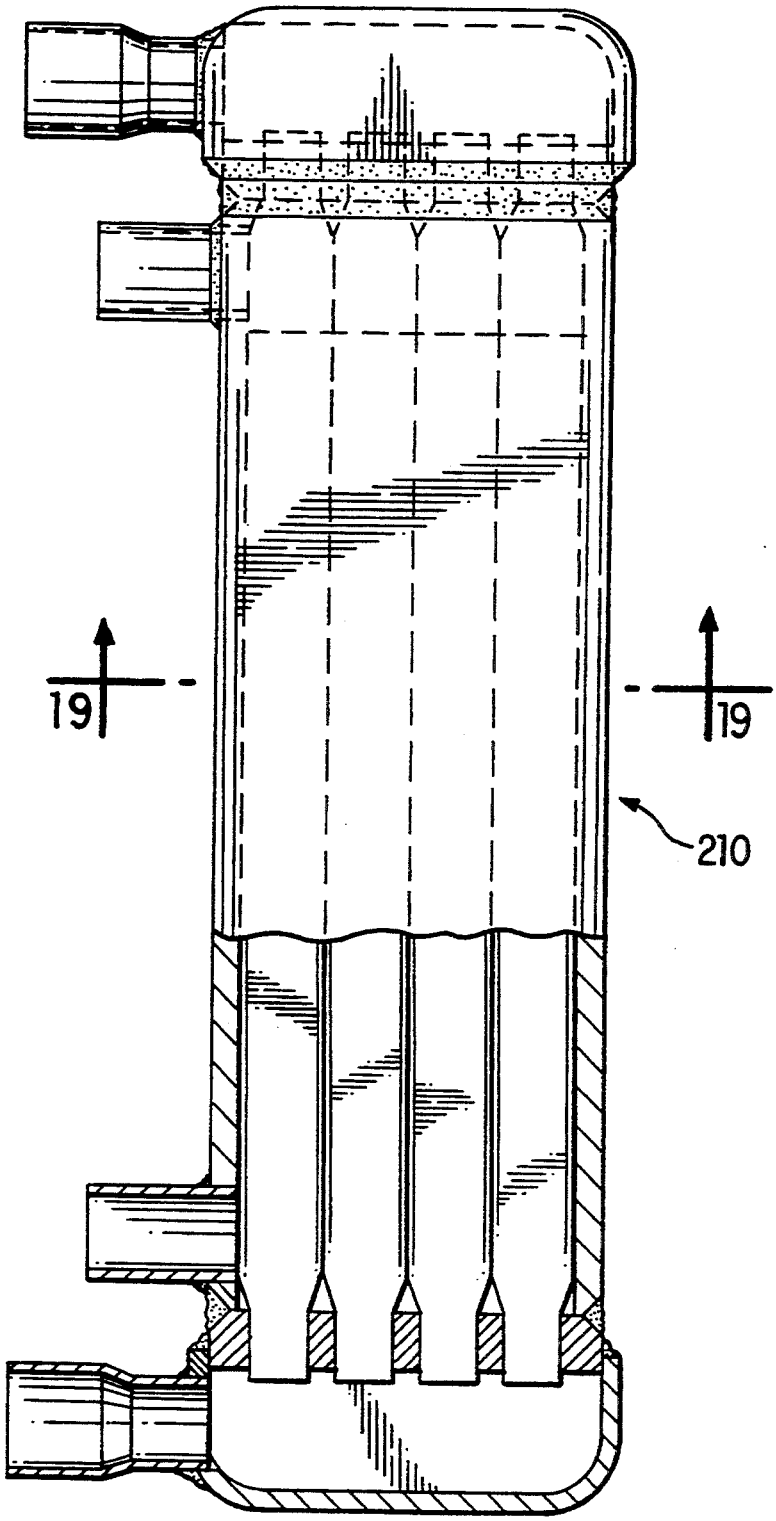
FIGS. 18–20 show a typical heat exchanger assembly with an orthogonal heat exchange element.
Figure 19:
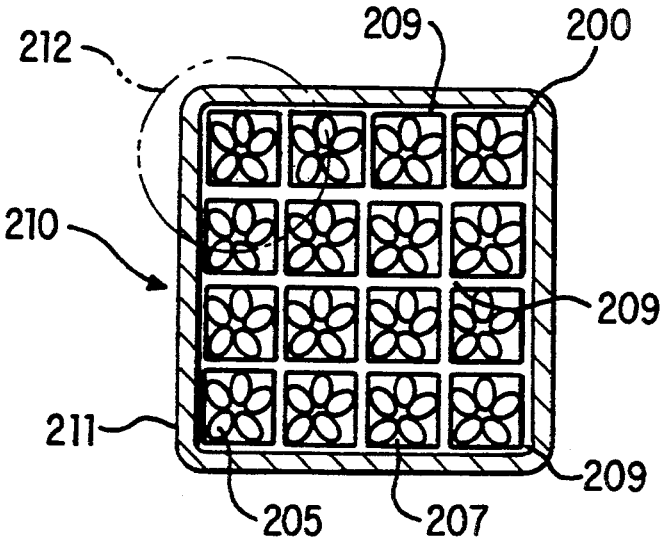
Figure 20:
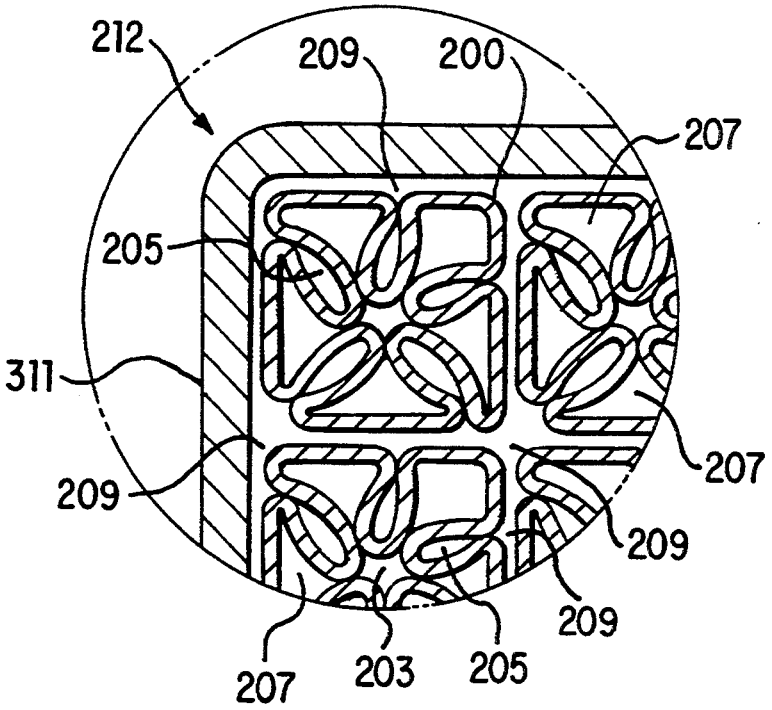

In an alternate embodiment of the invention, the element 1, which is substantially tube or cylinder shaped, may be transformed to an orthogonal shaped element 200 such as shown in FIGS. 14 and 15. FIG. 15 shows cross-section 15—15 in FIG. 14. To accomplish this transformation, element 1 is preferably passed through an apparatus 202 adapted to transform a tube element into a orthogonal element. See FIGS. 12–13. Such an apparatus is often referred to as a "Turk's Head" by persons skilled in the art. It preferably includes a tapered wall 204 which serves to feed the element 1 into the center 208 of a section 206 which is adapted to bend the tube to become substantially orthogonal shaped. Orthogonal shaped elements 200 may be advantageous in some applications since they may be more efficiently packed into heat exchangers such as shown in FIGS. 18–20. FIG. 19 shows cross-section 19—19 in FIG. 18. FIG. 20 is an expanded view of the circle 212 in FIG. 19. As shown in FIGS. 19–20, the heat exchanger 210 may include an element 200. Element 200 may have a center first fluid passage 203 which is substantially surrounded by second fluid passages 205, which are in turn substantially surrounded by first fluid passages 207, which may in turn be at least partially surrounded by outer second fluid passage 209. A plurality of elements 200 may be enclosed by heat exchanger walls 211.

It is contemplated that the element of the invention may be used in a variety of heat exchangers. For instance, the element may be used in the heat exchangers described in U.S. patent application Ser. No. 07/962,661 filed Oct. 19, 1992, and entitled "Tube and Shell Heat Exchanger with Linearly Corrugated Tubing" and U.S. patent application Ser. No. 07/962,662, filed Oct. 19, 1992, and entitled "Method of Pointing and Corrugating Heat Exchanger Tubing." Both of these patent applications were to L. Robert Zifferer.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein or in the steps or in the sequence of steps of the methods described herein without departing from the spirit and scope of the invention as described in the following claims.

I claim:

1. A multi-passage exchange element comprising:

a central first fluid passage for passage of a first fluid of a heat exchanger;

a plurality of substantially helically convoluted second fluid passages for passage of a second fluid of a heat exchanger, the second fluid passages substantially surrounding at least a portion of the central passage; and a plurality of substantially helically convoluted first fluid passages for passage of the first fluid of a heat exchanger, the first fluid passages substantially surrounding at least a portion of the second fluid passages; and a passageway connecting the central first fluid passage to at least one of the substantially helically convoluted first fluid passages.

2. The element of claim 1 wherein the element is a single-piece construction.

3. The element of claim 1 wherein the second fluid passages substantially surround the central passage.

4. The element of claim 1 wherein the central fluid passage and the first fluid passages substantially surround the second fluid passages.

5. The element of claim 1 wherein a cross section of the element is substantially circular.

6. The element of claim 1 wherein a cross section of the element is substantially orthogonal.

7. The element of claim 1 wherein the number of second fluid passages is between 3 and 8.

8. The element of claim 1 wherein the number of second fluid passages is 5.

9. The element of claim 1 wherein the number of first fluid passages is between 3 and 8.

10. The element of claim 1 wherein the number of first fluid passages is 5.

11. The element of claim 1, further comprising an outer second fluid passage, the outer second fluid passage substantially surrounding at least a portion of the first fluid passages.

12. The element of claim 1 wherein a minor amount of the first fluid in the central first fluid passage can leak to the first fluid passages during use, and vice versa.

13. The element of claim 11 wherein a minor amount of the second fluid in the second fluid passages can leak to the outer second fluid passage during use, and vice versa.

14. The element of claim 1 wherein the element is coupled to a corrugated element comprising a central first fluid passage with substantially helically convoluted corrugations, and wherein the corrugations are spaced apart from each other such that second fluid can pass between and outside of the corrugations during use.

15. The element of claim 14 wherein the element is coupled to the corrugated element such that second fluid passing between and outside of the corrugations can pass into the second fluid passages of the element.

16. The element of claim 15 wherein the element is constructed such that second fluid passing between and outside of the corrugations is directed into the second fluid passages of the element.

17. The element of claim 1 wherein a cross section of the second fluid passages comprises a substantially oval or tear shape.

18. The element of claim 1 wherein a cross section of the central passage comprises a central body portion with a plurality of outwardly extending points.

19. The element of claim 1 wherein a cross section of at least one second passage is substantially shoe or boot shaped.

20. A heat exchanger comprising the element of claim 1.

21. The element of claim 1 wherein the passageway connects the central first fluid passage to a plurality of the substantially helically convoluted first fluid passages during use.

22. A heat exchange element made according to the process of:

passing a tube through a die which is adapted to produce substantially helical corrugations in the tube, a cross section of a corrugation comprising a head portion and a neck portion, the neck portion being thinner than the head portion; and passing the corrugated tube through a reduction die which is adapted to bend the corrugations to form a plurality of helically convoluted passages substantially surrounding at least a portion of a central passage in the tube.

23. The element of claim 22 wherein the element is a single-piece construction.

24. The element of claim 22, further comprising an outer second fluid passage, the outer second fluid passage substantially surrounding at least a portion of the first fluid passage.

25. The element of claim 22 wherein a cross section of the element is substantially orthogonal.

26. A multi-passage exchange element comprising:

a central first fluid passage for passage of a first fluid of a heat exchanger;

a plurality of substantially helically convoluted second fluid passages for passage of a second fluid of a heat exchanger, the second fluid passages substantially surrounding at least a portion of the central passage;

a plurality of substantially helically convoluted first fluid passages for passage of the first fluid of a heat exchanger, the first fluid passages substantially surrounding at least a portion of the second fluid passages; and wherein a minor amount of the first fluid in the central first fluid passage can leak to the first fluid passages during use, and vice versa.

27. The element of claim 26 wherein the element is a single-piece construction.

28. The element of claim 26, further comprising an outer second fluid passage, the outer second fluid passage substantially surrounding at least a portion of the first fluid passage.

29. The element of claim 26 wherein a cross section of the element is substantially orthogonal.

30. A multi-passage exchange element comprising:

a central first fluid passage for passage of a first fluid of a heat exchanger;

a plurality of substantially helically convoluted second fluid passages for passage of a second fluid of a heat exchanger, the second fluid passages substantially surrounding at least a portion of the central passage;

a plurality of substantially helically convoluted first fluid passages for passage of the first fluid of a heat exchanger, the first fluid passages substantially surrounding at least a portion of the second fluid passages;

an outer second fluid passage, the outer second fluid passage substantially surrounding at least a portion of the first fluid passages; and wherein a minor amount of the first fluid in the central first fluid passage can leak to the first fluid passages during use, and vice versa.

31. The element of claim 30 wherein the element is a single-piece construction.

32. The element of claim 22, further comprising an outer second fluid passage, the outer second fluid passage substantially surrounding at least a portion of the first fluid passage.

33. The element of claim 30 wherein a cross section of the element is substantially orthogonal.

34. A multi-passage exchange element comprising:

a central first fluid passage for passage of a first fluid of a heat exchanger;

a plurality of substantially helically convoluted second fluid passages for passage of a second fluid of a heat exchanger, the second fluid passages substantially surrounding at least a portion of the central passage;

a plurality of substantially helically convoluted first fluid passages for passage of the first fluid of a heat exchanger, the first fluid passages substantially surrounding at least a portion of the second fluid passages; and wherein a cross section of the second fluid passages comprises a substantially oval or tear shape.

35. The element of claim 34 wherein the element is a single-piece construction.

36. The element of claim 34 wherein a cross section of the element is substantially orthogonal.

37. A multi-passage exchange element comprising:

a central first fluid passage for passage of a first fluid of a heat exchanger;

a plurality of substantially helically convoluted second fluid passages for passage of a second fluid of a heat exchanger, the second fluid passages substantially surrounding at least a portion of the central passage;

a plurality of substantially helically convoluted first fluid passages for passage of the first fluid of a heat exchanger, the first fluid passages substantially surrounding at least a portion of the second fluid passages; and wherein a cross section of at least one second passage is substantially shoe or boot shaped.

38. The element of claim 37 wherein the element is a single-piece construction.

39. The element of claim 37, further comprising an outer second fluid passage, the outer second fluid passage substantially surrounding at least a portion of the first fluid passage.

40. The element of claim 37 wherein a cross section of the element is substantially orthogonal.

* * * * *

UNITED STATES PATENT AND TRADEMARK OFFICE

CERTIFICATE OF CORRECTION

PATENT NO. : 5,409,057

DATED : April 25, 1995

INVENTOR(S) : L. Robert Zifferer

It is certified that error appears in the above-indentified patent and that said Letters Patent is hereby corrected as shown below:

Claim 32, col. 9, line 26, please delete the number "22" and substitute therefor the number --34--.

Signed and Sealed this

Twelfth Day of September, 1995

*Attest:*

*Attesting Officer*

Bruce Lehman

BRUCE LEHMAN

*Commissioner of Patents and Trademarks*